US005563015A

United States Patent [19]

Bonsignore et al.

[11] Patent Number: 5,563,015

[45] Date of Patent: Oct. 8, 1996

[54] LIQUID DEVELOPER COMPOSITIONS

[75] Inventors: Frank J. Bonsignore, Rochester; Scott D. Chamberlain, Macedon; James R. Larson, Fairport, all of N.Y.

[73] Assignee: Xerox Corporation, Stamford, Conn.

[21] Appl. No.: 505,043

[22] Filed: Jul. 21, 1995

Related U.S. Application Data

[63] Continuation-in-part of Ser. No. 204,016, Feb. 24, 1994, abandoned.

[51] Int. Cl.[6] ..... G03G 9/135

[52] U.S. Cl. ..... 430/106; 430/115

[58] Field of Search ..... 430/110, 106, 430/114, 115, 117

[56] References Cited

U.S. PATENT DOCUMENTS 5,451,483 9/1995 Fuller et al. ..... 430/115

*Primary Examiner*—John Goodrow
*Attorney, Agent, or Firm*—E. O. Palazzo

[57] ABSTRACT

A positively charged liquid developer comprised of a nonpolar liquid, thermoplastic resin particles, an optional charge adjuvant, optional pigment, and a charge director comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

I.

mono di

II.

wherein $R_1$ is selected from the group consisting of hydrogen and alkyl, and n represents a number.

33 Claims, No Drawings

LIQUID DEVELOPER COMPOSITIONS

This application is a continuation-in-part of patent application U.S. Ser. No. 08/204,016, abandoned the disclosure of which is totally incorporated herein by reference.

BACKGROUND OF THE INVENTION

This invention is generally directed to liquid developer compositions and, more specifically, the present invention relates to a liquid developer containing certain charge director mixtures. More specifically, the present invention relates to liquid developers comprised of charge directors comprised of mixtures wherein the mixtures can contain in embodiments from about 1 to about 99 weight percent of diesters, and from about 99 weight percent to about 1 weight percent of the aluminum complex mixture of organic phosphate mono and diesters and organic aluminum complexes of the following formulas

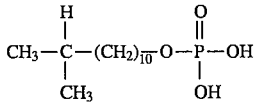

mono

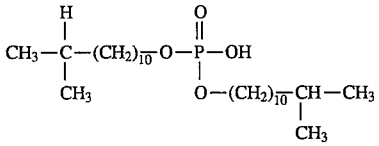

di and

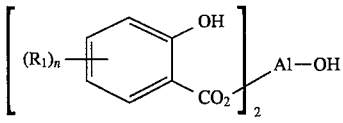

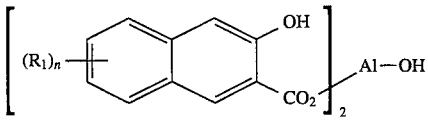

wherein $R_1$ is selected from the group consisting of hydrogen and alkyl; wherein alkyl, for example, contains from 1 to about 12 carbon atoms, and n represents a number, such as 1, 2, 3, or 4; and wherein the preferred aluminum complex embodiments is an aluminum-di-tertiary-butyl salicylate, or ALOHAS. The developers of the present invention can be selected for a number of known imaging systems, such as xerographic imaging and printing processes, including charged area development wherein latent images are rendered visible with the liquid developers illustrated herein. For image quality, solid area coverage and resolution of developed images one usually desires, for example, sufficient toner particle electrophoretic mobility. The mobility for effective image development is primarily dependent on the imaging system used, and this electrophoretic mobility is directly proportional to the charge on the toner particles and inversely proportional to the viscosity of the liquid developer fluid. For example, an about 10 to 30 percent change in fluid viscosity caused for instance by an about 5° C. to 15° C. decrease in temperature could result in a decrease in image quality, poor or unacceptable image development and undesirable image background development, for example, because of a 5 percent to 23 percent decrease in electrophoretic mobility. Insufficient particle charge can also result in poor, or no transfer of the developer or toner to paper, or other substrates. Poor transfer, for example, can result in poor image solid area coverage if insufficient toner is transferred to the final substrate and can also result in image defects such as smearing and hollowed fine features. To overcome or minimize such problems, the liquid toners of the present invention were arrived at after substantial research efforts, and which toners result in, for example, sufficient particle charge, generally corresponding to an ESA mobility greater than +2.0 E-10 $m^2/Vs$ for excellent transfer and maintaining the mobility within the desired range of the particular imaging system employed. Advantages associated with the present invention include improvements in the desired positive charge on the developer particles; in some instances the improvement, as measured by ESA mobility, is from +0.6 E-10 $m^2/Vs$ without the charge director mixtures of this invention to +3.4 E-10 $m^2/Vs$ when the charge director mixtures of the present invention are selected. The greater toner charge results in, for example, improved image development and higher quality images, such as higher resolutions with less background deposits.

A latent electrostatic image can be developed with toner particles dispersed in an insulating nonpolar liquid. The aforementioned dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin, optional pigment, and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 μm (microns) average by area size as measured with the Horiba 700 Particle Sizer.

Since the formation of proper images depends primarily on the difference of the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like, to the liquid developer comprising the thermoplastic resin, the nonpolar liquid and the colorant. A charge director can be of importance in controlling the charging properties of the toner to enable excellent quality images.

In U.S. Pat. No 5,035,972, the disclosure of which is totally incorporated herein by reference, there are illustrated liquid developers with quaternized ammonium AB diblock copolymer charge directors, and wherein the nitrogen in the ionic A block is quaternized with an alkylating agent.

U.S. Pat. No. 5,019,477, the disclosure of which is hereby totally incorporated by reference, discloses a liquid electrostatic developer comprising a nonpolar liquid, thermolplastic resin particles, and a charge director. The ionic or zwitterionic charge directors may include both negative charge directors such as lecithin, oil-soluble petroleum sulfonate and alkyl succinimide, and positive charge directors such as cobalt and iron naphthenates. The thermolplastic resin particles can comprise a mixture of (1) a polyethylene homolpolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate. As the copolymer of polyethylene and methacrylic acid or methacrylic acid alkyl esters, NUCREL® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The aforementioned liquid developers can be prepared by first dissolving the polymer resin in a liquid vehicle by heating at temperatures of from about 80° C. to 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of the block copolymer is oriented to the surface of the block polymer, and the compatible segment thereof is oriented to be compatible with other resins and a coloring agent contained in the toner so that the toner is provided with both liquid-repelling and solvent-soluble properties.

In U.S. Pat. No. 4,707,429 there are illustrated, for example, liquid developers with an aluminum stearate charge adjuvant. Liquid developers with, for example, certain aluminum salicylates as charge directors are illustrated in U.S. Pat. No. 5,045,425. Also, stain elimination in consecutive colored liquid toners is illustrated in U.S. Pat. No. 5,069,995.

In U.S. Pat. Nos. 5,306,591 and 5,308,731, the disclosures of which are totally incorporated herein by reference, there is illustrated a liquid developer comprised of thermoplastic resin particles, a charge director, and a charge adjuvant comprised of an imine bisquinone; and a liquid developer comprised of a liquid, thermoplastic resin particles, a nonpolar liquid soluble charge director, and a charge adjuvant comprised of a metal hydroxycarboxylic acid, respectively. In United States Statutory Invention Registration No. H1483, the disclosure of which is totally incorporated herein by reference, there is illustrated a liquid developer comprised of thermoplastic resin particles, and a charge director comprised of an ammonium AB diblock copolymer of the formula

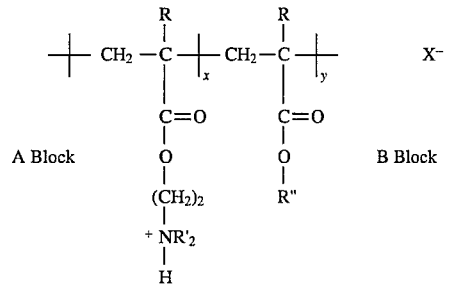

wherein X– is a conjugate base or anion of a strong acid; R is hydrogen or alkyl; R' is alkyl; R" is an alkyl group containing from about 6 to about 20 carbon atoms; and y and x represent the number average degree of polymerization (DP) wherein the ratio of y to x is in the range of from about 10 to 2 to about 100 to 20. The charge adjuvants and other appropriate components of these copending applications may be selected for the liquid toners of the present invention.

In U.S. Pat. No. 5,366,840, the disclosure of which is totally incorporated herein by reference, there is illustrated a liquid developer comprised of thermoplastic resin particles, an optional charge director, and a charge additive or adjuvant, including ALOHOS, comprised of a component of the formulas

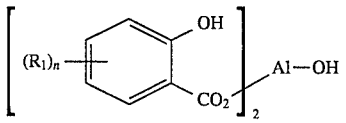

or

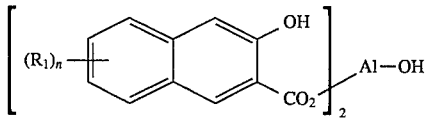

wherein $R_1$ is selected from the group consisting of hydrogen and alkyl, and n is 0 (zero), 1, 2, 3, or 4.

Illustrated in U.S. Pat. No. 5,409,796, the disclosure of which is totally incorporated herein by reference, is a positively charged liquid developer comprised of thermoplastic resin particles, optional pigment, a charge director, and a charge adjuvant comprised of a copolymer of an alkene and unsaturated acid derivative and wherein the acid derivative contains pendant ammonium groups, and wherein the charge adjuvant is associated with or combined with said resin and said optional pigment; and in U.S. Pat. No. 5,411,834, the disclosure of which is totally incorporated herein by reference, and filed concurrently herewith, is a negatively charged liquid developer comprised of thermoplastic resin particles, optional pigment, a charge director, and an insoluble charge adjuvant comprised of a copolymer of an alkene and unsaturated acid derivative and wherein the acid derivative contains pendant fluoroalkyl or pendant fluoroaryl groups, and wherein the charge adjuvant is associated with or combined with said resin and said optional pigment.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

SUMMARY OF THE INVENTION

It is an object of the present invention to provide a liquid developer with many of the advantages illustrated herein.

Another object of the present invention resides in the provision of a liquid developer capable of high particle charging.

Another object of the invention is to provide positively charged liquid developers wherein there are selected as charge directors mixtures of organic phosphate mono and diesters and organic aluminum complexes, which mixtures permit, for example, superior particle charging compared to when either of the aforementioned individual components are used alone, that is a synergistic result with the charge director mixture of the present invention.

It is still a further object of the invention to provide a liquid developer wherein developed image defects such as smearing, loss of resolution and loss of density are eliminated, or minimized, and wherein there are selected economical charge directors that permit toners that can be easily transferred from imaging members such as photoreceptor drums.

Also, in another object of the present invention there are provided positively charged liquid developers with certain charge adjuvants.

Another object of the present invention resides in the provision of liquid developers with known additives and adjuvants, and liquid developers with mixtures of organic phosphate mono and diesters and charge additives like BONTRON E-84™ and E-88™, reference for example U.S. Pat. No. 4,845,003, the disclosure of which is totally incorporated herein by reference, available from Orient Chemical Company; and wherein in embodiments a 1:1 mixture of the disesters and charge additives are selected.

These and other objects of the present invention can be accomplished in embodiments by the provision of liquid developers with certain charge director mixtures comprised of organic phosphate mono and diesters and organic aluminum complexes. In embodiments, the present invention is directed to positively charged liquid developers comprised of a toner resin, pigment, and a charge director comprised of mixtures of certain organic phosphate mono and diesters and organic aluminum complexes wherein the charge director comprises from about 1 to about 1,000 milligrams of charge director per 1 gram of developer solids wherein the developer solids are comprised of thermoplastic resin, pigment, and charge adjuvant. In embodiments, the present invention is directed to liquid developers with certain charge director mixtures. In embodiments, the present invention is directed to liquid developers comprised of a toner resin, charge adjuvant, pigment, and a charge director mixture comprised of an organic phosphate mono and diester and aluminum hydroxide charge director, such as the aluminum salts of alkylated salicylic acid like, for example, hydroxy bis(3,5-tertiary butyl salicylic) aluminate, and which salts can be represented by the following formulas

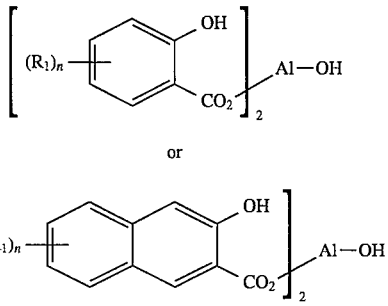

or wherein $R_1$ is selected from the group consisting of hydrogen and alkyl with, for example, 1 to about 25 carbon atoms; and n is zero, 1, 2, 3 or 4. Alkyl embodiments for $R_1$ include methyl, ethyl, propyl, or butyl, and preferably isopropyl, n-butyl, isobutyl, or tert-butyl. The aluminum salts are illustrated in U.S. Pat. No. 5,366,840 mentioned herein, the disclosure of which is totally incorporated herein by reference.

Important embodiments of the present invention are directed to a positively charged liquid developer comprised of a nonpolar liquid, thermoplastic resin particles, a non polar liquid insoluble charge adjuvant optional pigment, and a charge director comprised of a mixture of (1) a nonpolar liquid soluble organic phosphate mono and diester mixture derived from phosphoric acid and isotridecyl alcohol and (2) a nonpolar liquid soluble organic aluminum complex, or mixtures thereof, and wherein (1) and (2), respectively, are of the formulas

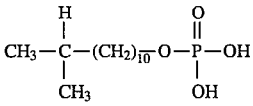

mono

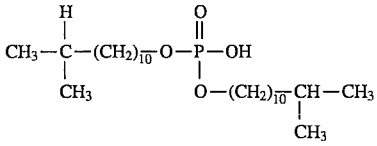

di

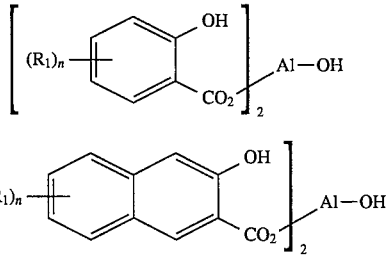

wherein $R_1$ is selected from the group consisting of hydrogen and alkyl, and n represents a number; and which phosphate esters are commercially available as EMPHOS, especially EMPHOS PS-900™ from Witco Corporation.

Examples of specific aluminum charge directors selected for the developers of the present invention, and present in various effective amounts as indicated herein, and, for example, from about 0.1 to about 15, and preferably from about 1 to about 4 weight percent, based on the weight, for example, of all the developer components, include aluminum di-tertiary-butyl salicylate; hydroxy bis(3,5-tertiary butyl salicylic) aluminate; hydroxy bis(3,5-tertiary butyl salicylic) aluminate mono-, di-, tri- or tetrahydrates; hydroxy bis(salicylic) aluminate; hydroxy bis(monoalkyl salicylic) aluminate; hydroxy bis(dialkyl salicylic) aluminate; hydroxy bis(trialkyl salicylic) aluminate; hydroxy bis(tetraalkyl salicylic) aluminate; hydroxy bis(hydroxy naphthoic acid) aluminate; hydroxy bis(monoalkylated hydroxy naphthoic acid) aluminate; bis(dialkylated hydroxy naphthoic acid) aluminate wherein alkyl preferably contains 1 to about 6 carbon atoms; bis(trialkylated hydroxy naphthoic acid) aluminate wherein alkyl preferably contains 1 to about 6 carbon atoms; bis(tetraalkylated hydroxy naphthoic acid) aluminate wherein alkyl preferably contains 1 to about 6 carbon atoms; and the like.

The aforementioned additives can be prepared as illustrated in U.S. Pat. Nos. 5,223,368 and 5,366,840, the disclosures of which are totally incorporated herein by reference, and more specifically, these additives can be obtained by the reaction of two equivalents of the sodium salt of, for example, 3,5-di-tert-butyl salicylic acid with one half equivalent of a dialuminum salt, for example aluminum sulfate, $Al_2(SO_4)_3$, in an aqueous alkali solution which generates a 2:1 complex of two salicylic acid molecules about a single central aluminum atom wherein both carboxylate groups of the salicylic acid moieties are covalently bonded through the carboxylate oxygen atom to the aluminum atom. It is also believed that the hydroxy aluminum complex compounds can have a hydroxyl group (—OH) that is covalently bonded to the aluminum atom (Al), that is an Al—OH. Also, the aromatic hydroxyl groups of the salicylic acid may be datively coordinated rather than covalently bonded to the central aluminum atom. The degree of hydration of the hydroxy aluminate complexes may vary as indicated by the subscript x and may be equal to 0, 1, 2, 3 or 4, and may depend upon how vigorously the complex is dried after isolation. It is further believed that the hydroxy aluminate complexes when formed with the processes as illustrated in U.S. Pat. No. 5,223,368 can in embodiments form mixtures with the mixture containing from 1 percent to 99 percent of each component. The water of hydration is believed to be strongly associated with the aluminum atom and is not easily removed upon heating under vacuum for 24 hours at 100° C. and above. Further, although not being desired to be limited to theory it is believed in embodiments that the negative charge enhancing ability of hydroxy aluminate complexes may derive negative charge directing ability from both the covalently bound hydroxyl group and the water of hydration. These structural features may serve to stabilize the complex and also serve as a reservoir of readily exchangeable protons. Therefore, the aluminum charge directors of the present invention in embodiments, reference for example the compounds of Formula 1A, can be prepared by the reaction of at least two molar equivalents of the sodium or alkali salt of a salicylic acid derivative wherein $R_1$ is hydrogen or alkyl with, for example, from 1 to about 25 carbon atoms, and wherein n represents the number of $R_1$ groups, and can be zero, 1, 2, 3 or 4 with a one molar aluminum equivalent of an aluminum containing salt, for example using a dialuminum salt such as aluminum sulfate, $Al_2(SO_4)_3$, being about one half molar equivalent. The aluminum salt reactant may be a hydrated compound, for example $Al_2(SO_4)_3 \cdot XH_2O$, and wherein X represents the number of water components such as 0 to about 25. The reaction sequence is preferably accomplished by first converting an alpha hydroxy carboxylic acid compound, that is a salicylic acid derivative, for example, when converting the formed compounds into the corresponding alkali metal salt, for example sodium, in an aqueous alkali solution. The aqueous alkali solution containing the alkali salt of the alpha hydroxy carboxylate is then added to an acidic aqueous solution containing the aluminum containing salt reactant with rapid stirring. This inverse addition ensures that the complexing aluminum species is initially present in excess relative to the concentration of the added sodium salt. The inverse addition also avoids or minimizes tris- complex formation, $[RCO_2]_3Al$, wherein R is alkyl, that is a product having three carboxylate containing ligands bonded to the aluminum atom and no hydroxy-aluminum bond. Cooling the reaction mixture to room temperature generates a precipitate that may be collected by filtration. The crude product may be purified further by washing with, for example, water or other suitable solvents until the acidity of the wash water is nearly constant, for example a pH of about 5.5. The product is preferably dried to a constant weight in a vacuum drying oven. The reaction can provide a 2:1 complex of two salicylic acid molecules arranged about a single central aluminum atom wherein both carboxylate groups of the salicylic acid moieties are covalently bonded through the carboxylate oxygen atom to the aluminum atom. It is also believed that the hydroxy aluminum complex compounds prepared in this manner have a hydroxyl group (—OH) that is covalently bonded to the aluminum atom.

The organic phosphate mono and diester charge director components are as indicated herein, including EMPHOS PS-900™, and which diesters and monoesters are available from Witco Chemical Corporation, Organic Division, Houston, Tex. This material is available as either the free acid or salt thereof, and with the present invention in embodiments the free acid, such as EMPHOS PS-900™, CAS Registry Number 52933-07-0, is preferably selected. The organic phosphate mono and diester components of the EMPHOS PS-900™ charge director mixture contains two free phosphoric acid hydrogens and one free phosphoric acid hydrogen per molecule, respectively. When the EMPHOS, especially EMPHOS PS-900™, organic phosphate component is an organic monoester, it is present, for example, in an amount of from about 30 to about 45 weight percent and when the EMPHOS, especially EMPHOS PS-900™, organic phosphate is an organic diester, it is present, for example, in an amount of from about 50 to about 65 weight percent. The EMPHOS PS900™ composition also typically contains, it is believed, about 5 to about 15 percent of unphosphated nonionic material which is excess isotridecyl alcohol, and up to 3 weight percent of phosphoric acid may be present according to information provided by Witco Corporation. The acid form of EMPHOS PS-900™ may be neutralized with a suitable base, such as triethanolamine for water soluble products or with fatty amines for oil soluble products. Witco Corporation indicates that the EMPHOS PS-900™ is comprised of the mono and di phosphate esters of isotridecyl alcohol as indicated herein, and of the formulas provided herein, and also a Witco representative has identified EMPHOS PS-900™ as the phosphate esters of isotridecyl alcohol, CAS Registry Number 52933-07-0, and indicates the ester may contain impurities, for example up to 3 weight percent of phosphoric acid and 2 weight percent of water. Some physical properties of the PS900™ material are provided in the Table below.

| TYPICAL PROPERTIES OF EMPHOS PS-900 ™ | |
|---|---|
| Appearance at 25° C. | Clear Liquid |
| Hydrophobic Base Unit or Nonpolar | Aliphatic = |

-continued

| TYPICAL PROPERTIES OF EMPHOS PS-900 ™ | |
|---|---|
| Foundation | Isotridecyl |
| Moisture Percent | About 1.0 to 2.0 |
| Specific Gravity at 25° C. | 0.97 |
| Pour Point, °F. | >50 |
| Acid Number to pH 5.5 | 160 |
| Acid Number to pH 9.5 | 250 |
| pH, 3% in water | 2.5 |
| Solubiity at 25% volume in: | |
| Mineral Oil | Soluble |
| Kerosene | Soluble |
| Xylene | Soluble |
| Ethanol | Soluble |
| Water | Dispersible |
| Caustic Soda, 10% | Insoluble |

Embodiments of the present invention include a positively charged liquid developer comprised of thermoplastic resin particles, and a charge director mixture; a liquid developer comprised of a liquid component thermoplastic resin; a charge director comprised of a mixture with one of the components being an organic phosphate mono and diester mixture as illustrated herein, and a charge adjuvant; and a positively charged liquid electrostatographic developer comprised of (A) a nonpolar liquid having viscosity of from about 0.5 to about 20 centipoise and a resistivity equal to or greater than about $5\times10^9$ with a maximum resistivity, for example, of $10^{20}$ in embodiments; (B) thermoplastic resin particles with an average volume particle diameter of from about 0.1 to about 30 microns and pigment; (C) charge adjuvant, and wherein the charge adjuvant is associated with or combined, preferably permanently, with the resin and pigment; and (D) a charge director comprised of a mixture of a first component of an organic phosphate mono and diester mixture, and a second component of an organic aluminum complex as illustrated herein. Effective mixtures range from about 10 percent organic aluminum complex and about 90 percent complex organic phosphate mono and diester to about 90 percent organic aluminum complex and about 10 percent organic mono and diphosphate ester with a preferred range being about 30 percent organic aluminum complex and about 70 percent organic phosphate mono and diester to about 70 percent aluminum complex and about 30 percent organic phosphate mono and diester, all in weight percent.

In embodiments, the present invention relates to a liquid developer comprised of thermoplastic resin particles, and a charge director which is an organic phosphate mono and diester mixture or a mixture of an organic phosphate mono and diester mixture and an organic aluminum complex as illustrated herein.

A positively charged liquid developer of the present invention having a charge sufficient to result in a particle mobility equal to or greater than about $2.0\times10^{-10}$ $m^2/Vs$ (meters squared per volt second) and preferably greater than about $2.50\times10^{-10}$ $m^2/Vs$, for example about $2.5\times10^{-9}$ $m^2/Vs$, as measured with the Matec ESA apparatus is comprised of a liquid component, thermoplastic resin pigment, and an optional charge adjuvant, and a charge director mixture comprised of a first component of a complex organic phosphate mono and diesters mixture and a second component of an organic aluminum complex or mixtures of organic aluminum complex, where each aluminum complex of the mixture is present in an amount of from about 1 to about 99 percent by weight, and preferably from about 35 to about 75 percent by weight, as illustrated herein, which charge directors are present in various effective amounts, such as for example from about 1 to about 1,000 milligrams of charge director mixture to 1 gram of developer solids, which developer solids include resin, pigment, and optional charge adjuvant; and a liquid electrostatographic developer comprised of (A) a liquid having viscosity of from about 0.5 to about 20 centipoise and a resistivity greater than $5\times10^9$ ohm-cm; (B) thermoplastic resin particles with an average volume particle diameter of from about 0.1 to about 30 microns; (C) an optional charge adjuvant; and (D) a charge director mixture comprised of an organic, that is carbon containing phosphate esters or a mixture thereof, and an organic aluminum complex as illustrated herein In embodiments, the toner is comprised of thermoplastic resin, charge adjuvant, and the pigment. Therefore, it is important that the thermoplastic resin and the charge adjuvant be sufficiently compatible that they do not form separate particles, and that the charge adjuvant be insoluble in the hydrocarbon to the extent that no more than 0.1 weight percent be soluble in the nonpolar liquid.

The charge director mixture of phosphate ester and aluminum complex can be selected for the liquid developers in various effective amounts, such as for example in embodiments from about 1 to 1,000 milligrams of charge director per gram of toner solids and preferably 10 to 100 milligrams/gram. Developer solids include toner resin, pigment, and optional charge adjuvant. Without pigment, the developer may be selected for the generation of a resist, a printing plate, and the like.

Examples of liquid carriers, or nonpolar liquids selected for the developers of the present invention include a liquid with an effective viscosity as measured, for example, by a number of known methods, such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon as illustrated herein. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR®M has a flash point of 80° C. as determined by the ASTM D-56 method. The liquids selected should have an electrical volume resistivity in excess of 109 ohm-centimeters and a dielectric constant below 3.0. Moreover, the vapor pressure at 25° C. should be less than 10 Torr in embodiments. The amount of liquid carrier or nonpolar liquid selected is from about 75 to about 99.9 weight percent and preferably between 95 and 99 weight percent.

Although in embodiments the ISOPAR® series liquids can be the preferred nonpolar liquids for use as dispersants in the liquid developers of the present invention, the essential characteristics of viscosity and resistivity may be achieved with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developers of the present invention is as indicated herein, for example from about 75 percent to about 99.9 percent, and preferably from about 95 to about 99 percent by weight of the total developer solids dispersion. The total solids components content of the developer is, for example, from about 0.1 to about 25 percent by weight, preferably 1.0 to 5 percent.

Typical suitable optional thermoplastic toner resin can be selected for the liquid developers of the present invention in effective amounts of, for example, in the range of from about 99 percent to about 40 percent, and preferably about 95 percent to about 70 percent of developer solids comprised of thermoplastic resin, pigment, charge adjuvant, and in embodiments other optional components such as magnetic materials, like magnetites that may comprise the developer. Generally, developer solids include the thermoplastic resin, pigment and charge adjuvant. Examples of thermoplastic resins include ethylene vinyl acetate (EVA) copolymers, (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers selected in embodiments are comprised of the copolymer of ethylene and an α-β-ethylenically unsaturated acid of either acrylic acid or methacrylic acid. In a preferred embodiment, NUCREL® resins available from E. I. DuPont de Nemours and Company like NUCREL 599®, NUCREL 699®, or NUCREL 960® are selected as the thermoplastic resin.

The liquid developer of the present invention preferably contains a colorant dispersed in the resin particles. Colorants, such as pigments or dyes like black, cyan, magenta, yellow, red, blue, green, brown, and mixtures wherein any one colorant may comprise from 0.1 to 99.9 weight percent of the colorant mixture with a second colorant comprising the remaining percentage thereof are preferably present to render the latent image visible.

The colorant may be present in the resin particles in an effective amount of, for example, from about 0.1 to about 60 percent, and preferably from about 10 to about 30 percent by weight based on the total weight of solids contained in the developer. The amount of colorant selected may vary depending on the use of the developer; for instance, if the toned image is to be used to form a chemical resist image no pigment is necessary. Examples of colorants such as pigments which may be selected include carbon blacks available from, for example, Cabot Corporation (Boston, Mass.), such as MONARCH 1300®, REGAL 330® and BLACK PEARLS® and color pigments like FANAL PINK™, PV FAST BLUE™, and Paliotol Yellow D1155; pigments as illustrated in U.S. Pat. No. 5,223,368, the disclosure of which is totally incorporated herein by reference; and the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET | Ciba-Geigy | Violet 42 |
| Maroon B | | |
| STERLING ® NS BLACK | Cabot | Black 7 |
| STERLING ® NSX 76 | Cabot | |
| TIPURE ® R-101 | DuPont | White 6 |

-continued

| PIGMENT BRAND NAME | MANU-FAC-TURER | COLOR |
|---|---|---|
| MOGUL ® L | Cabot | Black, CI 77266 |
| UHLICH ® BK 8200 | Paul Uhlich | Black |

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustics effect, the application of an electric field, and the measurement of sound as illustrated in U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high mobilities have been shown to result in improved image density, higher image resolution and superior transfer efficiency, for example U.S. Pat. Nos. 5,066,821, 5,034,299, and 5,028,508, the disclosures of which are totally incorporated herein by reference. Residual conductivity, that is the conductivity from the charge director, can be measured with a low field device as described in the Examples.

To increase the toner particle charge and, accordingly, increase the mobility and transfer latitude of the toner particles, charge adjuvants can be added to the toner particles. For example, adjuvants, such as metallic soaps, like aluminum or magnesium stearate or octoate, fine particle size oxides, such as oxides of silica, alumina, titania, and the like, paratoluene sulfonic acid, and polyphosphoric acid, may be added. Negative charge adjuvants increase the negative charge of the toner particle, that is they can serve to decrease the positive charge, while the positive charge adjuvants increase the positive charge of the toner particles. With the invention of the present application, the adjuvants or charge additive can be comprised of copolymers of an alkene and unsaturated acid derivatives, such as acrylic acid and methacrylic acid derivatives, containing pendant ammonium copolymers of ethylene and methacrylic acid esters with the ester groups having pendant ammonium groups such as a copolymer of ethylene and N,N,N-trimethylammonium-2-ethylmethacrylate bromide, a copolymer of ethylene and N,N,N-trimethylammonium- 2-ethylmethacrylate tosylate, a copolymer of ethylene and N,N-dimethylammonium-2-ethylmethacrylate hydrogen tosylate, a copolymer of ethylene and N,N-dimethylammonium-2-ethylmethacrylate hydrogen bromide, a copolymer of ethylene and N,N-dimethylammonium- 2-ethylmethacrylate hydrogen dinonylnaphthalenesulfonate, and the like. The charge adjuvants can be added to the liquid toner particles in an amount of from about 1 percent to about 100 percent of the total developer solids of toner resin, pigment, and charge adjuvant, and preferably from about 10 percent to about 50 percent of the total weight of solids contained in the developer.

The liquid electrostatic developer of the present invention can be prepared by a variety of known processes, such as, for example, mixing in a nonpolar liquid with the thermoplastic resin, charge adjuvant, and colorant in a manner that the resulting mixture contains, for example, from about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer, for example, from to about 10 to about 20 percent by weight; cooling the dispersion to about 10° C. to about 50° C.; adding the charge director mixture to the dispersion; and diluting the dispersion to 1 percent to 2 percent solids.

In the initial mixture, the resin, colorant and charge adjuvant may be added separately to an appropriate vessel which can vary in size from about 50 milliliters to about 1,000 liters such as, for example, an attritor, heated ball mill, heated vibratory mill, such as a Sweco Mill (manufactured by Sweco Company, Los Angeles, Calif.) equipped with particulate media for dispersing and grinding, a Ross double planetary mixer (manufactured by Charles Ross and Son, Hauppauge, N.Y.), or a two roll heated mill, which requires no particulate media. Useful particulate media include materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of from about 0.04 to about 0.5 inch (approximately 1.0 to approximately 13 millimeters).

Sufficient nonpolar liquid is added to provide in embodiments a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, adjuvant and resin. However, the temperature at which this step is undertaken should not be so high as to degrade the nonpolar liquid or decompose the resin or colorant when present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, or glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation and liquid developers thereof are generally illustrated in U.S. Pat. Nos. 4,760,009; 5,017,451; 4,923,778 and 4,783,389, the disclosures of which are totally incorporated herein by reference.

Examples of charge adjuvants present in various effective amounts, such as from about 0.1 to about 15 weight percent in embodiments, are as illustrated herein, such as an adduct of a copolymer poly(ethylene-co-methacrylic acid) (NURCEL 599®) dimethylaminoethyl ester and p-methyl toluenesulfonate, an adduct of a copolymer poly(ethylene-co-methacrylic acid) (NURCEL 599®) dimethylaminoethyl ester and p-toluenesulfonic acid, an adduct of a copolymer poly(ethylene-co-methacrylic acid) (NURCEL 599®) dimethylaminoethyl ester and dinonylnaphthalenesulfonic acid, or an adduct of a copolymer poly(ethylene-co-methacrylic acid) (NURCEL 599®) dimethylaminoethyl ester and hydrogen bromide.

Embodiments of the invention will be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per the manufacturer's recommendation to provide an ESA signal corresponding to a zeta potential of −26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzers manufactured by Horiba Instruments, Inc, Irvine, Calif.

Image quality of the developers of the invention was determined on a modified Savin 870 copier. This device comprises a Savin 870 copier with the modifications described below.

1) Disconnecting the image density feedback loop from the development electrode and connecting the electrode to a Trek Model 610 high voltage power supply (Trek, Medina, N.Y.).

2) Disconnecting the transfer corona and connecting same to a Trek Model 610 high voltage power supply (Trek, Medina, N.Y.).

To evaluate positive developers, the above device or machine was operated with a reverse image target with white characters on a black background such that the image had a positive voltage less than the development voltage and the background had a positive voltage greater than the image voltage, thus resulting in the positive particles being pushed selectively onto the image area. Development voltage was 1,000 volts. Transfer to paper (Xerox 4024 paper) was conducted at −6500 volts. Print density was measured using a Macbeth RD918 Reflectance Densitometer.

EXAMPLE I

Preparation of NUCREL 599®-Acid Chloride (26383-104-1):

In accordance with U.S. Pat. No. 4,681,831, the disclosure of which is totally incorporated herein by reference, a 3-neck, 1-liter flask equipped with a reflux condenser, argon inlet, Dean-Stark trap, syringe septum, and a mechanical stirrer was charged with NUCREL 599® (50 grams) and toluene (500 milliliters). A silicone oil bath at 140° C. was used to heat the flask to remove 40 milliliters of cloudy distillate. The reaction mixture was then cooled to 63° C. and oxalyl chloride (9 grams) was added. After 1 hour at 60° C., a 25 milliliter aliquot was removed and dried in vacuo at 50° C. for 16 hours. A FTIR spectrum of the resulting solid residue revealed 3 carbonyl absorbances. The predominant absorbance peak at 1,799 $cm^{-1}$ was assigned to the acid chloride of NUCREL 599®.

EXAMPLE II

Preparation of NUCREL® 599-Dimethylaminoethanol Ester (26383-104-20):

A 3-neck, 1 liter flask, equipped with a reflux condenser, argon inlet, Dean-Stark trap, syringe septum, and a mechanical stirrer was charged with NUCREL 599® (50 grams) and toluene (500 milliliters). A silicone oil bath at 140° C. was used to remove 40 milliliters of cloudy distillate. The reaction was then cooled to 63° C. and oxalyl chloride (9 grams) was added. After 1 hour at 63° C., dimethylaminoethanol (100 milliliters, 89.0 grams) was added, and the reaction temperature was increased to 75° C. After 20 hours at 75° C., the reaction was 97 percent completed. The reaction was allowed to proceed for 50 hours at 75° C. before the hot solution was added to methanol to precipitate a polymer which was isolated by filtration, washed with methanol using a Waring blender, and then vacuum dried to yield 52.7 grams of white powder (26383-104-50), identified as the dimethylaminoethyl ester of NUCREL 599®.

EXAMPLE III

Reaction of Methyl Bromide with NUCREL® 599-Dimethylaminoethyl Ester (26384-10):

NUCREL 599®-dimethylamino-ethyl ester (26383-104-50, 30 grams) was combined with toluene (150 grams) in a 500 milliliter capacity Parr pressure reaction vessel. The suspension was then chilled in a dry ice bath, and then 200 milliliters of 2 molar methyl bromide (38.0 grams, 10 molar equivalents) in t-butyl methyl ether were added. The pressure vessel was gently purged, sealed, and then pressurized to 60 psi with argon. The reactor was heated to 100° C. for 16 hours with continued stirring. The reactor was cautiously vented and the contents were added rapidly to 2 liters of methanol to precipitate the product which was isolated by filtration, washed with methanol, and then vacuum dried to yield 30 grams of white polymer, identified as the adduct of methyl bromide with the dimethylaminoethyl ester of NUCREL 599®.

EXAMPLE IV

12 Liter Scale Preparation of Dimethylaminoethyl Ester of NUCREL 599® (26384-73):

A 12-liter round-bottom, 3-neck flask equipped with a reflux condenser, argon inlet, distillation take-off head, thermometer, glass stopper, and a mechanical stirrer was charged with NUCREL 599® (600 grams) and toluene (6 liters, 5,203 grams). A heating mantle was used to heat the flask to remove 477.5 grams of distillate which was initially cloudy and then became clear. The reaction solution was then cooled to 60° C. and oxalyl chloride (108.6 grams) was added. Vigorous gasing and foaming took place and some reflux was evident. After 2 hours between 55° and 60° C., the reaction temperature was increased to between 75° C. and 80° C. Dimethylaminoethanol(1.2 liters, 1,057 grams) was added and the reaction was allowed to proceed for 50 hours at 80° C. with continuous stirring. The hot solution was added to methanol to precipitate a white polymer which was isolated by filtration, washed with additional methanol using a Waring blender, refiltered, and then vacuum dried to yield 625 grams of product identified as the dimethylaminoethyl ester of NUCREL 599®.

EXAMPLE V

Reaction of NUCREL 599®-Dimethylaminoethyl Ester with p-Methyl Tosylate (26384-77):

The dimethylaminoethyl ester of NUCREL 599® (26384-73, 100 grams) and toluene (700 grams) were added to a 3-liter, 3-neck, round-bottom flask equipped with a mechanical stirrer, thermometer, water-cooled condenser and argon inlet. A silicone oil bath was used to heat the mixture to 80° C. and the polymer suddenly dissolved. Para (p)-methyl toluene sulfonate (24 grams) in toluene (200 grams) was added, and the reaction mixture was then heated and maintained at 100° C. for 43 hours with continuous stirring. The mixture was then allowed to cool to 25° C. and was filtered to isolate a fine-particulate, transparent polymeric gel which was twice washed with more toluene (1 liter) using a Waring blender. Filtration and air drying yielded a white powder which was washed with methanol (1 liter), isolated by filtration and then air dried to yield 113.8 grams of product identified as the adduct of NUCREL 599®-dimethylaminoethyl ester with p-methyl toluenesulfonate.

EXAMPLE VI

Reaction of NUCREL® 599-Dimethylaminoethyl Ester with p-Toluenesulfonic Acid (26384-80):

The dimethylaminoethyl ester of NUCREL 599® (26384-73, 100.9 grams) and toluene (716.9 grams) were added to a 3-liter, 3-neck, round-bottom flask equipped with a mechanical stirrer, thermometer, water-cooled condenser and argon inlet. A silicone oil bath was used to heat the mixture to 115° C. (the polymer dissolved suddenly near 80° C.). p-Toluenesulfonic acid monohydrate (24.4 grams) was added at 115° C. and was washed into the reaction vessel with toluene (39.8 grams). The reaction mixture was maintained at 115° C. for 2 hours with continuous stirring. A brief reaction time was used because the monohydrate might hydrolyze the dimethylamino-ester groups attached to the modified NUCREL 599®. The mixture was then allowed to cool to 25° C. and was filtered to isolate a fine-particulate, transparent polymeric gel which was twice washed with more toluene (1 liter) using a Waring blender. Filtration and air drying yielded a white powder which was washed with methanol (1 liter), isolated by filtration, and then vacuum dried to yield 111 grams of product identified as the adduct of NUCREL 599®-dimethylaminoethyl ester with p-toluenesulfonic acid.

EXAMPLE VII

Reaction of NUCREL 599®-Dimethylaminoethyl Ester with Dinonylnaphthalenesulfonic Acid (26384-83):

The dimethylaminoethyl ester of NUCREL 599® (26384-73, 100.3 grams) and toluene (775 grams) were added to a 3-liter, 3-neck, round-bottom flask equipped with a mechanical stirrer, thermometer, water-cooled condenser and argon inlet. A silicone oil bath was used to heat the mixture to 70° C., at which temperature the polymer dissolved. Dinonylnaphthalenesulfonic acid (NACURE 1053™, King Industries, Norwalk, Conn., 118.9 grams of a 50 weight percent solids solution in xylene) was added with toluene (83.8 grams) at 80° C. The reaction mixture was then heated and maintained at 100° C. for 2 hours with continuous stirring. The mixture was then allowed to cool to 25° C. The coagulated resin that formed on cooling was isolated by filtration, and added to methanol (1 liter) using a Waring blender to form a fine-particulate, unfilterable dispersion. The dispersion was then added to water (3 liters) to precipitate a polymer which was isolated by filtration, washed with methanol (1 liter) and then dried to yield 129.6 grams of product, identified as the adduct of NUCREL 599®-dimethylaminoethyl ester with dinonylnaphthalenesulfonic acid.

EXAMPLE VIII

Reaction of NUCREL 599®-Dimethylaminoethyl Ester with Hydrogen Bromide (26384-84):

Two reaction products from the following Runs 1 and 2 were combined and designated 26384-84.

Run 1: Toluene (300.4 grams) and NUCREL 599®-dimethylaminoethyl ester (26384-73, 50.3 grams) were combined in a glass-lined Parr-pressure reaction vessel (500 milliliters capacity) and hydrogen bromide was added from a lecture bottle until 1,000 psi was achieved. The vessel was then heated to 100° C. for 2 hours with stirring. The vessel was maintained at 1,000 psi with three additional charges of hydrogen bromide gas from the lecture bottle. After cooling to 25° C. and then cautious venting of unreacted gas, the resultant orange gel was washed with methanol using a Waring blender until a white product was obtained after filtration.

Run 2: Toluene (250 grams) and NUCREL 599®-dimethylaminoethyl ester (51.2 grams) were combined in a glass-lined Parr pressure reaction vessel (500 milliliters capacity), heated with stirring to 100° C., and then pressurized with hydrogen bromide gas from a lecture bottle until 800 psi was achieved. The pressure was maintained at 800 psi with two additional charges of hydrogen bromide gas from the lecture bottle. After 38 minutes, the vessel was cautiously vented and the warm solution was added to methanol (2 liters). The coagulated yellow polymer was isolated by filtration and washed repeatedly with methanol using a Waring blender until a white product was obtained, and the filtrate was colorless. The resin obtained from runs 1 and 2 were combined and air dried to yield 90 grams of product identified as the adduct of NUCREL 599®-dimethylaminoethyl ester with hydrogen bromide.

EXAMPLE IX

12 Liter Preparation of NUCREL 599®-Dimethylaminoethyl Ester (26384-85):

This procedure is similar to that followed to prepare 26384-73, reference Example IV. A 12 liter round-bottom, 3-neck flask equipped with a reflux condenser, argon inlet, distillation take-off head, thermometer, glass stopper, and a mechanical stirrer was charged with NUCREL 599® (600 grams) and toluene (6 liters, 5,213 grams). A heating mantle was used to heat the flask to remove 679 grams of distillate which was initially cloudy and then became clear. The reaction solution was then allowed to cool to 60° C. and oxalyl chloride (106.4 grams) was added. Within 2 minutes, vigorous gasing and foaming took place and some reflux was evident. After 2 hours at 60° C., the reaction temperature was increased to 85° C. Dimethylaminoethanol (1.2 liters, 1,101 grams) was added. The reaction mixture was then heated and maintained at 90° C. for 48 hours with continuous stirring. The hot solution was added to methanol (16 liters) to precipitate a white polymer which was isolated by filtration, washed with additional methanol using a Waring blender, refiltered, and then vacuum dried to yield 633 grams of product identified as the dimethylaminoethyl ester of NUCREL 599®.

EXAMPLE X

12 Liter Reaction of p-Methyl Tosylate and NUCREL 599®-Dimethylaminoethyl Ester (26384-87):

This procedure is similar to one followed to prepare 26384-77, reference Example V. A 12-liter round-bottom, 3-neck flask equipped with a reflux condenser, argon inlet, distillation take-off head, thermometer, glass stopper, and a mechanical stirrer was charged with NUCREL 599®-dimethylaminoethyl ester (26384-85,600 grams) and toluene (4,200 grams). A heating mantle was used to heat the flask to 87° C. and some effervescence was observed. Methyl p-toluenesulfonate (154.9 grams) was added with toluene (36.6 grams) to wash the reagent into the vessel. The reaction mixture was then heated to 115° C. to remove 152 grams of distillate which was initially cloudy and then became clear. The reaction solution was then allowed to cool to 100° C. and was maintained there for 40 hours with continuous stirring. The mixture was then allowed to cool to 25° C., and the resultant coagulated polymer was isolated by filtration as a fine-particulate, transparent polymeric gel which was twice washed with more toluene (1 liter) using a Waring blender. Filtration and air drying yielded a white powder, which was washed with methanol (1 liter), isolated by filtration and then air dried to yield the adduct of NUCREL 599®-dimethylaminoethyl ester with p-methyl toluenesulfonate.

CHARGE DIRECTOR SYNTHESIS:

CONTROL 1

Synthesis of Hydroxy Bis(3,5-Tertiary Butyl Salicylic) Aluminate Monohydrate at Elevated Temperature:

To a solution of 12 grams (0.3 mole) NaOH in 500 milliliters of water were added 50 grams (0.2 mole) of di-tert-butyl salicylic acid. The resulting mixture was heated to 60° C. to dissolve the acid. A second solution was prepared by dissolving 33.37 grams (0.05 mole) of aluminum sulfate, $Al_2(SO_4)_3 \cdot 18H_2O$ into 200 milliliters of water with heating to 60° C. The former solution containing the sodium salicylate salt was added rapidly and dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid hydroxy bis(3,5-tertiary butyl salicylic) aluminate monohydrate was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of >300° C. When a sample, about 50 grams, of the hydroxy bis(3,5-tertiary butyl salicylic) aluminate monohydrate was analyzed for water of hydration by Karl-Fischer titration after drying for an additional 24 hours at 100° C. in a vacuum, the sample contained 2.1 percent weight of water. The theoretical value calculated for the monohydrate is 3.2 percent weight of water.

Infrared spectra of the above product hydroxy bis(3,5-tertiary butyl salicylic) aluminate monohydrate indicated the absence of peaks characteristic of the starting material di-tert-butyl salicylic acid, and indicated the presence of a Al—OH band characteristic at 3,660 $cm^{-1}$ and peaks characteristic of water of hydration.

NMR analysis for the hydroxy aluminate complex was obtained for carbon, hydrogen and aluminum nuclei and were all consistent with the above prepared hydroxymonohydrate.

Elemental Analysis Calculated for $C_{30}H_{41}O_7Al$: C,66.25; H, 7.62; Al, 5.52. Calculated for $C_{30}H_{41}O_7Al \cdot 1H_2O$: C, 64.13; H, 7.74; Al, 4.81. Found: C, 64.26; H, 8.11; Al, 4.67.

Synthesis of Hydroxy Bis(3,5-Tertiary Butyl Salicylic)Aluminate Hydrate at Room Temperature:

The procedure of charge director Synthesis I, Control I, above was repeated with the exception that the mixing of the two solutions and subsequent stirring was accomplished at room temperature, about 25° C. The product was isolated and dried as in Charge Director Synthesis I, and identified as the above hydroxy aluminum complex hydrate by IR.

PREPARATION OF LIQUID (LID)INKS OR DEVELOPERS:

EXAMPLE XI

Toner Containing No Charge Adjuvant (Toner 26788-2 No CCA Magenta):

177.2 Grams of NUCREL 599® (a copolymer of ethylene and methacrylic acid with a melt index at 190° C. of 500 available from E. I. DuPont de Nemours & Company, Wilmington, Del.), 50.0 grams of the magenta pigment (FANAL PINK™), and 307.4 grams of NORPAR 15™ (Exxon Corporation) were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 85° C. to 93° C. for 2 hours and cooled by running water through the attritor jacket to 14° C. with an additional 980.1 grams of NORPAR 15™ added and ground in the attritor for an additional 7.5 hours. An additional 1,517 grams of NORPAR 15™ were added and the mixture was separated from the steel balls yielding a toner concentrate of 7.21 percent solids wherein the solids included 78 weight percent of NUCREL 599® toner resin, and 22 weight percent of magenta pigment. This toner concentrate was diluted to 1 percent solids by addition of NORPAR 15®. A 200 gram sample of this 1 percent solids toner was charged by the addition of 0.2 gram of hydroxy bis(3,5-tertiary butyl salicylic) aluminate hydrate (Control 1) charge director. A second 200 gram sample of this 1 percent solids toner was charged by the addition of 0.1 gram of hydroxy bis(3,5-tertiary butyl salicylic) aluminate hydrate (Control 1) and 0.1 gram of EMPHOS PS-900™ (Witco) charge director. The conductivity and mobility of these samples were measured. The results are presented in Table 1. A third sample of toner was prepared by selecting 194.2 grams of the 7.21 weight percent toner concentrate and mixing it with 1,170.8 grams of NORPAR 15® and 35 grams of a 4 percent by weight 1:1 mixture of hydroxy bis(3,5-tertiary-butyl salicylic) aluminate hydrate (Control 1) and EMPHOS PS-900™ (Witco). This sample was image quality tested in a Savin 870 copier. The results are presented in Table 2. A fourth sample of toner was prepared by selecting 194.2 grams of the 7.21 weight percent toner concentrate and mixing it with 1,135.8 grams of NORPAR 15™ and 70 grams of a 2 percent by weight of hydroxy bis(3,5-tertiary-butyl salicylic) aluminate hydrate (Control 1). This sample was image quality tested in a Savin 870 copier. The results are presented in Table 2.

EXAMPLE XII 26788-10 Magenta Toner Containing Resin that was 50 Percent NUCREL® 599 and 50 Percent 26384-77, the Adduct of Methyl Tosylate and Dimethyl Amine of NUCREL® 599:

88.6 Grams of NUCREL 599® (a copolymer of ethylene and methacrylic acid with a melt index at 190° C. of 500 available from E. I. DuPont de Nemours & Company, Wilmington, Del.), 50.0 grams of the magenta pigment (FANAL PINK™), 88.6 grams of the additive component of Example V, and 307.4 grams of NORPAR 15™ (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 85° C. to 93° C. for 2 hours and cooled by running water through the attritor jacket to 16° C. with an additional 980.1 grams of NORPAR 15™ added and ground in the attritor for an additional 6.5 hours. An additional 1,517 grams of NORPAR 15™ were added and the mixture was separated from the steel balls yielding a toner concentrate of 7.22 percent solids wherein the solids comprised of 39 weight percent of NUCREL 599® toner resin, 22 weight percent of magenta pigment, and 39 weight percent of the additive of Example V. A 200 gram sample of this 1 percent solids toner was charged by the addition of 0.2 gram of hydroxy bis(3,5-tertiary butyl salicylic) aluminate hydrate (Control 1) charge director. A second 200 gram sample of this 1 percent solids toner was charged by the addition of 0.1 gram hydroxy bis(3,5-tertiary butyl salicylic) aluminate hydrate (Control 1) and 0.1 gram of EMPHOS PS-900™ (Witco) charge director. A third 200 gram sample of this 1 percent solids toner was charged by the addition of 0.2 gram of EMPHOS PS-900™ (Witco) charge director. The conductivity and mobility of these samples were measured. The results are presented in Table 1. A fourth sample of toner was prepared by selecting 193.9 grams of the 7.22 weight percent toner concentrate and mixing it with 1,171.1 grams of NORPAR 15™ and 35 grams of a 4 percent by weight 1:1 mixture of hydroxy bis(3,5-tertiary-butyl salicylic) aluminate hydrate (Control 1) and EMPHOS PS-900™ (Witco). This sample was image quality tested in a Savin 870 copier. The results are presented in Table 2. A fifth sample of toner was prepared by taking 193.9 grams of the 7.22 weight percent toner concentrate and mixing it with 1,136.1 grams of NORPAR 15™ and 70 grams of a 2 percent by weight of hydroxy bis(3,5-tertiary-butyl salicylic) aluminate hydrate (Control 1). This sample was image quality tested in a Savin 870 copier. The results are presented in Table 2.

EXAMPLE XIII 26788-12 Magenta Toner Containing Resin that was 50 Percent NUCREL 599® and 50 Percent 26384-80, the Adduct of H-Tosylate and Dimethyl Amine of NUCREL® 599:

88.6 Grams of NUCREL 599® (a copolymer of ethylene and methacrylic acid with a melt index at 190° C. of 500 available from E. I. DuPont de Nemours & Company, Wilmington, Del.), 50.0 grams of the magenta pigment (FANAL PINK™), 88.6 grams of additive from Example VI, and 307.4 grams of NORPAR 15™ (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 92° C. to 102° C. for 2 hours, and cooled by running water through the attritor jacket to 21° C. with an additional 980.1 grams of NORPAR 15™ added and ground in the attritor for an additional 5.0 hours. An additional 1,508 grams of NORPAR 15™ were added and the mixture was separated from the steel balls yielding a toner concentrate of 6.89 percent solids wherein the solids were comprised of 39 weight percent of NUCREL 599® toner resin, 22 weight percent of magenta pigment, and 39 weight percent of the component of Example VI. A 200 gram sample of this 1 percent solids toner was charged by the addition of 0.2 gram hydroxy bis(3,5-tertiary butyl salicylic) aluminate hydrate (Control 1) charge director. A second 200 gram sample of this 1 percent solids toner was charged by the addition of 0.1 gram hydroxy bis(3,5-tertiary butyl salicylic) aluminate hydrate (Control 1) and 0.1 gram of EMPHOS PS-900™ (Witco) charge director. The conductivity and mobility of these samples were measured. The results are presented in Table 1.

EXAMPLE XIV 26788-15 Magenta Toner Containing Resin that was 50 Percent NUCREL 599® and 50 Percent 26384-83, the Adduct of Dinonyl Naphthalene Sulfonic Acid and Dimethyl Amine of NUCREL 599®:

88.6 Grams of NUCREL 599® (a copolymer of ethylene and methacrylic acid with a melt index at 190° C. of 500 available from E. I. DuPont de Nemours & Company, Wilmington, Del.), 50.0 grams of the magenta pigment (FANAL PINK™), 88.6 grams of the additive component of Example VII, and 307.4 grams of NORPAR 15 ™ (Exxon Corporation) were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 87° C. to 92° C. for 2 hours and cooled by running water through the attritor jacket to 15° C. with an additional 980.1 grams of NORPAR 15 ™ added and ground in the attritor for an additional 4.5 hours. An additional 1,494 grams of NORPAR 15™ were added and the mixture was separated from the steel balls yielding a toner concentrate of 7.27 percent solids wherein the solids were comprised of 39 weight percent of NUCREL 599® toner resin, 22 weight percent of magenta pigment, and 39 weight percent of the component of Example VII:. A 200 gram sample of this 1 percent solids toner was charged by the addition of 0.2 gram hydroxy bis(3,5-tertiary butyl salicylic) aluminate hydrate (Control 1) charge director. A second 200 gram sample of this 1 percent solids toner was charged by the addition of 0.1 gram hydroxy bis(3,5-tertiary butyl salicylic) aluminate hydrate (Control 1) and 0.1 gram of EMPHOS PS-900™ (Witco) charge director. The conductivity and mobility of these samples were measured. The results are presented in Table 1.

EXAMPLE XV 26788-17 Magenta Toner Containing Resin that was 50 Percent NUCREL 599® and 50 Percent 26384-84, the Adduct of HBr and Dimethyl Amine of NUCREL 599®:

88.6 Grams of NUCREL 599® (a copolymer of ethylene and methacrylic acid with a melt index at 190° C. of 500 available from E. I. DuPont de Nemours & Company, Wilmington, Del.), 50.0 grams of the magenta pigment (FANAL PINK™), 88.6 grams of the component of Example VIII, and 307.4 grams of NORPAR 15™ (Exxon Corporation) were added to a Union Process 15 attritor (Union Process Company, Akron, Ohio) charged with 0.1875 inch (4.76 millimeters) diameter carbon steel balls. The resulting mixture was milled in the attritor which was heated with running steam through the attritor jacket at 86° C. to 97° C. for 2 hours and cooled by running water through the attritor jacket to 20° C. with an additional 980.1 grams of NORPAR 15™ added and ground in the attritor for an additional 4.5 hours. An additional 1,506 grams of NORPAR 15™ were added and the mixture was separated from the steel balls yielding a toner concentrate of 7.15 percent solids wherein the solids were comprised of 39 weight percent of NUCREL 599® toner resin, 22 weight percent of magenta pigment, and 39 weight percent of the additive component of Example VIII. A 200 gram sample of this 1 percent solids toner was charged by the addition of 0.2 gram of hydroxy bis(3,5-tertiary butyl salicylic) aluminate hydrate (Control 1) charge director. A second 200 gram sample of this 1 percent solids toner was charged by the addition of 0.1 gram of hydroxy bis(3,5-tertiary butyl salicylic) aluminate hydrate (Control 1) and 0.1 gram of EMPHOS P5-900™ (Witco) charge director. The conductivity and mobility of these samples were measured. The results are presented in Table 1.

TABLE 1

| EXAMPLE | ADDITIVE: Toner Resin Bound Charge Adjuvant | CHARGE DIRECTOR | PARTICLE RADIUS BY AREA (microns) | MOBLITY ($10^{-10}$ $m^2/Vs$) | ZETA POTEN-TIAL (mV) | CONDUC-TIVITY (ps/cm) |
|---|---|---|---|---|---|---|
| Example XI | None | Control 1 | 0.91 | 1.23 | 81 | 14 |
| Example XI | None | 1:1 Control 1: EMPHOS PS900 | 0.91 | 1.48 | 98 | 4 |
| Example XII | Example V | Control 1 | 0.59 | 0.62 | 30 | 55 |
| Example XII | Example V | 1:1 Control 1: EMPHOS PS900 | 0.59 | 3.44 | 160 | 7 |
| Example XII | Example V | EMPHOS PS900 | 0.59 | 0.07 | 3 | 1 |
| Example XIII | Example VI | Control 1 | 0.60 | 0.69 | 34 | 49 |
| Example XIII | Example VI | 1:1 Control 1: EMPHOS PS900 | 0.60 | 2.91 | 143 | 6 |
| Example XIV | Example VII | Control 1 | 0.46 | 2.39 | 98 | 32 |
| Example XIV | Example VII | 1:1 Control 1: EMPHOS PS900 | 0.46 | 2.99 | 122 | 7 |
| Example XV | Example VIII | Control 1 | 0.44 | 2.31 | 92 | 25 |
| Example XV | Example VIII | 1:1 Control 1: EMPHOS PS900 | 0.44 | 2.47 | 99 | 6 |

TABLE 2

| EXAMPLE | ADDITIVE | CHARGE DIRECTOR | PRINT DENSITY |
|---|---|---|---|
| Example XI | None | 1:1 Control 1: Emphos PS900 | 1.36 |
| Example XI | None | Control 1 | No Image |
| Example XIII | Example V | 1:1 Control 1: Emphos PS900 | 1.68 |
| Example XIII | Example V | Control 1 | No Image |

Other embodiments and modifications of the present invention may occur to those skilled in the art subsequent to a review of the information presented herein; these embodiments and modifications, as well as equivalents thereof, are also included within the scope of this invention.

What is claimed is:

1. A positively charged liquid developer comprised of a nonpolar liquid, thermoplastic resin particles, an optional charge adjuvant, optional pigment, and a charge director comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

I.

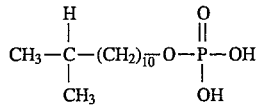

mono

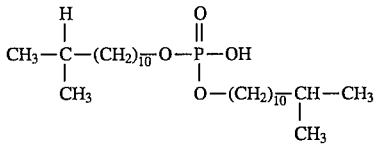

di

II.

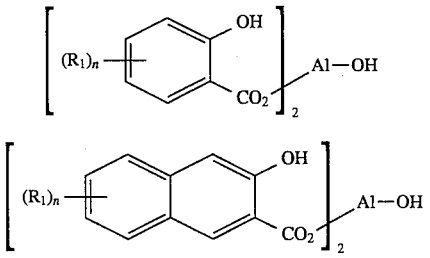

wherein $R_1$ is selected from the group consisting of hydrogen and alkyl, and n represents a number.

2. A developer in accordance with claim 1 wherein the phosphate mono and diester mixture is EMPHOS PS-900™.

3. A developer in accordance with claim 1 wherein alkyl contains from 1 to about 25 carbon atoms.

4. A developer in accordance with claim 1 wherein $R_1$ methyl, ethyl, propyl, or butyl; and n is 0, 1, 2, 3, or 4.

5. A developer in accordance with claim 1 wherein $R_1$ is isopropyl, n-butyl, isobutyl, or tert-butyl; and n is 0, 1, 2, 3, or 4.

6. A developer in accordance with claim 1 wherein the aluminum complex is of the formula as represented by

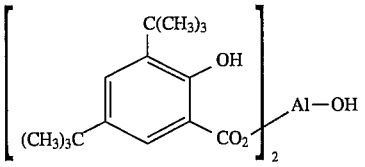

or

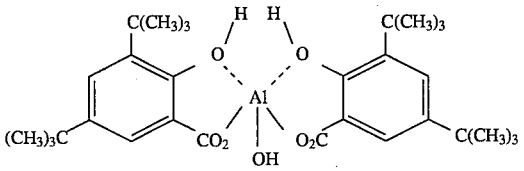

7. A developer in accordance with claim 1 wherein the aluminum complex is selected from the group consisting of hydroxy bis(3,5-di-tert-butyl salicylic) aluminate, hydroxy bis(3,5-di-tert-butyl salicylic) aluminate monohydrate, hydroxy bis(3,5-di-tert-butyl salicylic) aluminate dihydrate, hydroxy bis(3,5-di-tert-butyl salicylic) aluminate tri- or tetrahydrate, and mixtures thereof.

8. A positively charged liquid electrostatographic developer comprised of (A) a liquid with a viscosity of from about 0.5 to about 20 centipoise and resistivity greater than or equal to about $5\times10^9$; (B) thermoplastic resin particles with an average volume particle diameter of from about 0.1 to about 30 microns, and pigment; (C) nonpolar liquid insoluble charge adjuvant; and (D) a nonpolar liquid soluble charge director mixture of (1) an organic phosphate mono and diester mixture, and (2) a nonpolar liquid soluble organic aluminum complex; and wherein the charge adjuvant is associated with or combined with said resin and said pigment.

9. A developer in accordance with claim 1 wherein the resin is a copolymer of ethylene and an α-β-ethylenically unsaturated acid selected from the group consisting of acrylic acid and methacrylic acid; a copolymer of ethylene acrylic acid or a copolymer of a methacrylic acid, an alkylester of acrylic acid or an alkyl ester of methacrylic acid; or a copolymer of ethylene and methacrylic acid with a melt index at about 190° C. of about 500.

10. A developer in accordance with claim 8 wherein the resin is a copolymer of ethylene and an α-β-ethylenically unsaturated acid selected from the group consisting of acrylic acid and methacrylic acid; a copolymer of ethylene acrylic acid or a copolymer of a methacrylic acid, an alkylester of acrylic acid or an alkyl ester of methacrylic acid; or a copolymer of ethylene and methacrylic acid with a melt index at about 190° C. of about 500.

11. A developer in accordance with claim 1 wherein the pigment is present in an amount of about 0.1 to 60 percent by weight based on the total weight of the developer solids of resin, pigment, and charge adjuvant.

12. A developer in accordance with claim 1 containing a charge adjuvant in an amount of from about 0.1 to about 5 weight percent based on the amount of developer solids of resin, pigment and charge adjuvant.

13. A developer in accordance with claim 1 wherein the pigment is black, cyan, magenta, yellow, or mixtures thereof.

14. A developer in accordance with claim 13 wherein the pigment is carbon black.

15. A developer in accordance with claim 12 wherein the charge adjuvant is present in an amount of from about 1 to about 100 weight percent based on the weight of the developer solids, and there is enabled a positively charged developer.

16. A developer in accordance with claim 8 wherein component (A) is present in an amount of from about 85 percent to about 99.9 percent by weight, based on the total weight of the liquid developer, the total weight of developer solids is from about 0.1 percent to about 15 percent by weight, and component (D) is present in an amount of from about 5 to about 1,000 milligrams/gram of developer solids.

17. A developer in accordance with claim 8 wherein component (C) is present in an amount of from about 1 to about 100 percent by weight of developer solids.

18. A developer in accordance with claim 1 wherein the charge adjuvant, or additive is an adduct of a copolymer poly(ethylene-co-methacrylic acid) (NURCEL 599®) dimethylaminoethyl ester and p-methyl toluenesulfonate, an adduct of a copolymer poly(ethylene-co-methacrylic acid) (NURCEL 599®) dimethylaminoethyl ester and p-toluenesulfonic acid, an adduct of a copolymer poly(ethylene-co-methacrylic acid) (NURCEL 599®) dimethylaminoethyl ester and dinonylnaphthalenesulfonic acid, or an adduct of a copolymer poly(ethylene-co-methacrylic acid) (NURCEL 599®) dimethylaminoethyl ester and hydrogen bromide.

19. A developer in accordance with claim 1 wherein the liquid is an aliphatic hydrocarbon.

20. A developer in accordance with claim 19 wherein the aliphatic hydrocarbon is a mixture of branched hydrocarbons with from about 12 to about 20 carbons atoms, or wherein the aliphatic hydrocarbon is a mixture of normal hydrocarbons of from about 10 to about 20 carbon atoms.

21. A developer in accordance with claim 8 wherein the aluminum complex of component (D) is an alkyl salicylic acid aluminum complex.

22. A developer in accordance with claim 8 wherein the aluminum complex of component (D) is a hydroxy bis(3,5-tertiary butyl salicylic) aluminate monohydrate.

23. A developer in accordance with claim 8 wherein the aluminum complex of component (D) is a mixture of hydroxy bis(3,5-di-tertiary butyl salicylic) aluminate monohydrate.

24. A developer in accordance with claim 1 wherein said phosphate esters are present in an amount of from about 1 to about 99 weight percent of the mixture, and said aluminum complex or mixture thereof is present in an amount of from about 1 to about 99 weight percent of the mixture.

25. A developer in accordance with claim 1 wherein there is further included a charge additive of aluminum stearate.

26. An imaging method which comprises forming an electrostatic latent image followed by the development thereof with a liquid developer comprised of a nonpolar liquid, thermoplastic resin particles, a nonpolar liquid insoluble charge adjuvant, optional pigment, and a charge director comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

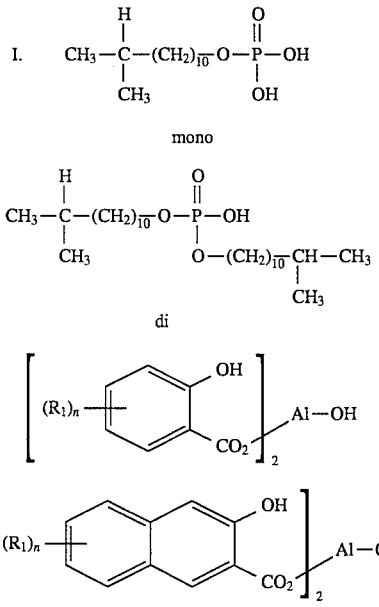

wherein $R_1$ is selected from the group consisting of hydrogen and alkyl, and n represents a number.

27. A liquid developer in accordance with claim 1 wherein said soluble organic phosphate mono and diester mixture is EMPHOS PS-900™, CAS registry Number 52933-07-0.

28. A liquid developer in accordance with claim 27 wherein said charge director mixture contains two free phosphoric acid hydrogens, and one free phosphoric acid hydrogen per molecule, respectively.

29. A positively charged liquid developer comprised of a nonpolar liquid, thermoplastic resin particles, pigment, and a charge director comprised of a mixture of I, a nonpolar liquid soluble organic phosphate mono and diester mixture derived from phosphoric acid and isotridecyl alcohol, and II, a nonpolar liquid soluble organic aluminum complex of the formulas

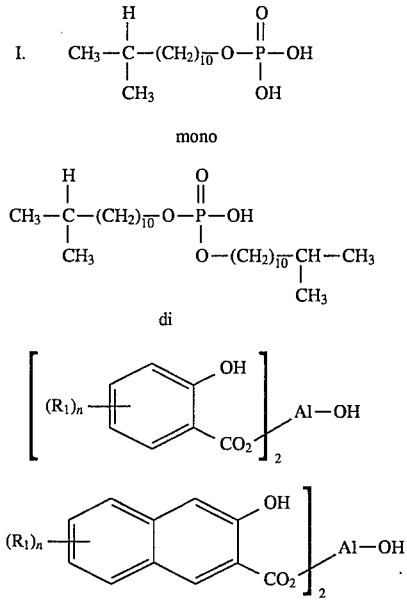

wherein $R_1$ is selected from the group consisting of hydrogen and alkyl, and n represents a number.

30. A liquid developer in accordance with claim 29 wherein the developer further includes a charge adjuvant.

31. A liquid developer in accordance with claim 30 wherein the pigment is carbon black.

32. A process in accordance with claim 30 wherein the pigment is selected from the group consisting of cyan, magenta, yellow, and mixtures thereof.

33. A positively charged liquid developer consisting essentially of a nonpolar liquid, thermoplastic resin particles, pigment, and a charge director comprised of a mixture of I, a nonpolar liquid soluble organic phosphate mono and diester mixture derived from phosphoric acid and isotridecyl alcohol, and II, a nonpolar liquid soluble organic aluminum complex of the formulas

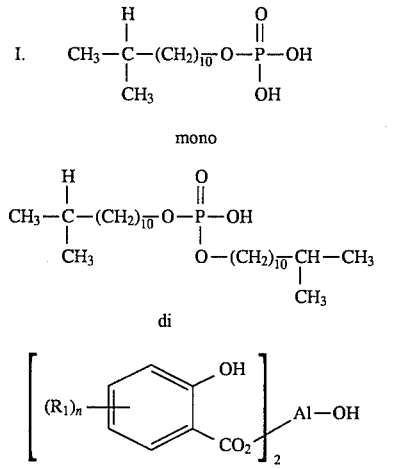

-continued
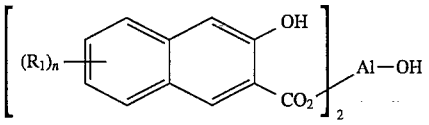
wherein $R_1$ is selected from the group consisting of hydrogen and alkyl, and n represents a number.
* * * * *